US007129904B2

(12) United States Patent
Chen

(10) Patent No.: US 7,129,904 B2
(45) Date of Patent: Oct. 31, 2006

(54) SHAPED DIPOLE ANTENNA

(75) Inventor: Tai-Lee Chen, Taipei (TW)

(73) Assignee: USPEC Technology Co., Ltd., Taipei (TW)

( * ) Notice: Subject to any disclaimer, the term of this patent is extended or adjusted under 35 U.S.C. 154(b) by 37 days.

(21) Appl. No.: 11/088,707

(22) Filed: Mar. 23, 2005

(65) Prior Publication Data

US 2006/0214867 A1 Sep. 28, 2006

(51) Int. Cl.
*H01Q 9/28* (2006.01)

(52) U.S. Cl. ..... 343/795

(58) Field of Classification Search ..... 343/795, 343/895, 700 MS, 702, 893
See application file for complete search history.

(56) References Cited

U.S. PATENT DOCUMENTS 4,513,292 A * 4/1985 Bowman ..... 343/795
4,686,536 A * 8/1987 Allcock ..... 343/700 MS
5,771,024 A * 6/1998 Reece et al. ..... 343/725
6,714,162 B1 * 3/2004 Kadambi et al. .... 343/700 MS
6,819,300 B1 * 11/2004 Gottl ..... 343/799
6,859,176 B1 * 2/2005 Choi ..... 343/700 MS
6,956,536 B1 * 10/2005 Lee ..... 343/793
7,030,827 B1 * 4/2006 Mahler et al. ..... 343/772

* cited by examiner

*Primary Examiner*—Trinh Dinh
*Assistant Examiner*—Huedung Mancuso
(74) *Attorney, Agent, or Firm*—The Maxham Firm

(57) ABSTRACT

An antenna structure is proposed. The structure includes two feeding conducting strips and two comb structures which are composed of plural conducting strips. The signals enter the two comb structures through the feeding conducting strips such that multi-oscillations occur between the comb structures under strong coupling effect, and produce radiations of multi-band or broadband.

10 Claims, 4 Drawing Sheets

SHAPED DIPOLE ANTENNA

FIELD OF THE INVENTION

The present invention relates to an antenna configuration, and more particularly to an improved dipole antenna.

BACKGROUND OF THE INVENTION

The development of operating frequency for wireless communication, such as radio, TV broadcasting system, and cellular phone, has oriented toward the broadband applications, such as digital video broadcasting, ultra wide band, and etc. The design for broadband antenna is required to improve the shape and minimize the size, especially for antenna for consumer electrical products.

Conventional dipole antenna is a basic configuration for antenna structure. In theory, the positive and negative charges are oscillated between the dipole, thereby generating the electromagnetic (EM) radiation. The oscillation mechanism is limited by the physical dimension such as length. Typically, the length between the dipole is the integral multiple half-wavelength of EM wave. The available operating frequency is extremely narrow; hence it is unlikely to be introduced in broadband communication.

The Bowtie dipole antenna is one of the conventional antennas that are capable of being operated for wide-band application. In the scheme, the antenna becomes wider gradually from the feeding point to both sides to form a bowtie shape, wherein the feeding point is the center of the bowtie. Since this antenna has divergent current distribution, the operating bandwidth is extended. However, the current distribution is mainly caused by edge condition, therefore, there are innate limitations to the bandwidth, radiation pattern, and feeding impedance match.

SUMMARY OF THE INVENTION

A purpose of this invention is to provide an antenna structure, which can generate oscillation with extensive operation frequency for broadband wireless transmission.

Another purpose of this invention is to provide an antenna structure, which can generate oscillation with multi-band for multi-band wireless transmission.

Yet another purpose of this invention is to provide an antenna structure, including two feeding conducting strips and comb structures composed of plural conducting strips connecting thereon. Transmission signals are introduced into the comb conducting structures via the feeding conducting strips to form dipole oscillation and then radiation effect. Since the currents are introduced into the plural conducting strips, the oscillation could generate multi-band or broadband under electromagnetic coupling effect depending on the difference of current paths.

DETAILED DESCRIPTION OF THE PREFERRED EMBODIMENT

Figure 1:
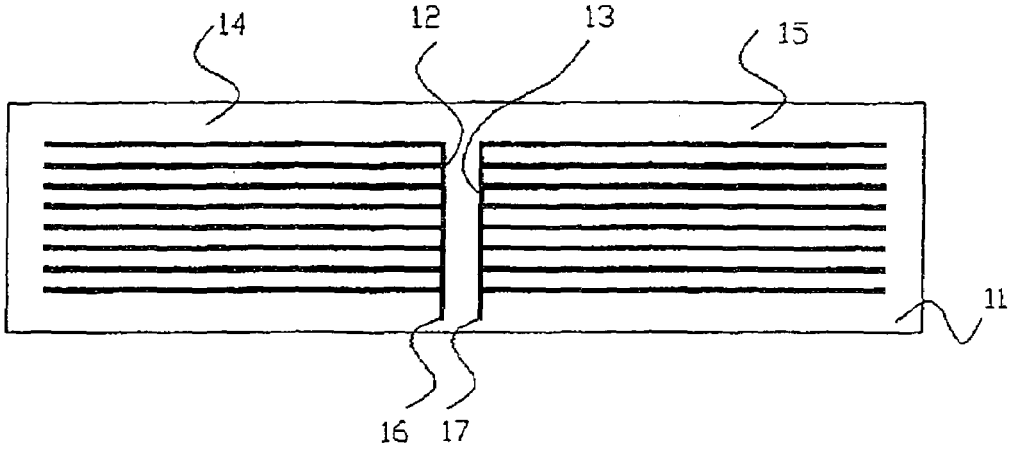
FIG. 1 is a plane view of a comb dipole antenna according to the first embodiment of this invention.

An embodiment of this invention, as shown in FIG. 1, it includes a substrate 11, two feeding conducting strips 12, 13, and two comb conducting structures 14, 15 formed on the substrate 11. The two feeding conducting strips 12, 13 and the two comb conducting structures 14, 15 are attached on the same side of the substrate 11. The substrate 11 is made of nonconductor medium adapted to electromagnetic radiation. Terminals 16, 17 of the feeding conducting strips 12, 13 are the signal feeding points. The comb conducting structures 14, 15 are configured with more than three conducting strips spaced from one another. The terminals of the conducting strips of the comb conductive structure 14 are connected to the feeding conductive strip 12, and those of comb conducting structure 15 are connected to the feeding conductive strip 13. During transmitting, the signals are fed via terminals 16, 17, and the currents flow into the plural conductive strips of the comb conducting structures 14, 15 through the feeding conducting strips 12, 13, respectively. The direction of signals is opposite during the receiving mode. In cooperation with the feeding conducting strips 12, 13, the parts of conducting strips in feeding conducting structures 12, 13 and those in comb conducting structure 15 can generate oscillation with half wavelength of operation frequency or the integral multiple of it to form electromagnetic radiation. High electromagnetic (EM) coupling and phase adjustment phenomenon occur between the plural conducting strips in comb conducting structures of the present invention. A plurality of different current paths are generated due to the varied conducting strips in the comb structure under the high EM coupling, thereby generating multi-band or broadband effect. When the lengths of feeding conducting strips 12, 13 both are shorter than a quarter of the wavelength of smallest operation frequency, dipole-like radiation patterns appear in varied frequency bands. The fashion and distance of feeding conducting strips 12, 13 as well as the length and shape of conducting strips of comb conducting structures 14, 15 are adjusted to achieve required operation frequency band and impedance match. The radiation pattern of this invention is similar to that of a dipole antenna, which has other radiation patterns by altering the shape of comb conducting structure.

Figure 2:
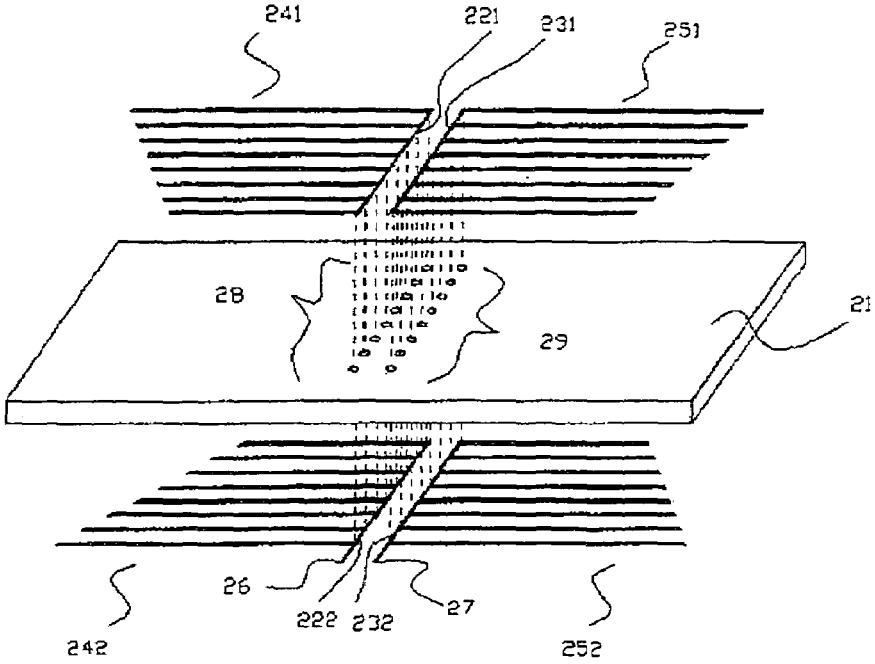
FIG. 2 is a plane view of a comb dipole antenna according to the second embodiment of this invention.

Another embodiment of the present invention is shown in FIG. 2, the embodiment includes a substrate 21, two signal terminals 26, 27, four feeding conducting strips 221, 222, 231, 232, and four comb conducting structures 241, 242, 251, 252. The substrate 21 is made of nonconductor adapted for electromagnetic radiation. The comb conducting structures 241, 242, 251,252 are formed by the arrangement of more than three conducting strips spaced from each other. The comb conducting structures 241, 242, 251,252 connect to the feeding conducting strips 221, 222, 231, 232 by either ends of plural conducting strips therein. The feeding conducting strips 221 and 222 are connected by conducting via holes 28 and linked with signal terminal 26 respectively, and the feeding conducting strips 231 and 232 are connected by conducting via holes 29 and linked with signal terminal 27 respectively. In cooperation with the feeding conducting strips 221, 222, 231, 232, the parts of conducting strips in comb conducting structures 241, 242 and those in comb conducting structures 251, 252 can generate oscillation with half wavelength of operation frequency or integral multiple of the half wavelength to produce electromagnetic radiation. The conducting strips in comb conducting structures are not necessarily equal in length. Hence, more combinations of frequency oscillation can be obtained so as to increasing frequency width. The fashion and distance of feeding conducting strips 221, 222, 231, 232 as well as the length and shape of comb conducting structures 241, 242, 251, 252 are adjusted to achieve required operation frequency band and impedance match. Other circuit structures and principles are the same as those of first embodiment.

Figure 3:
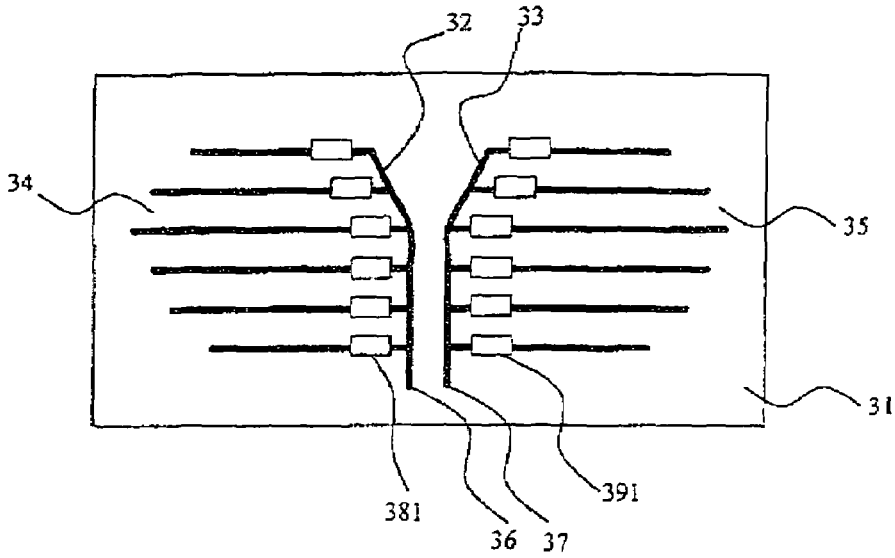
FIG. 3 is a plane view of a comb dipole antenna according to the third embodiment of this invention.

Yet another embodiment of the present invention, as shown in FIG. 3, the basic structure is identical to the aforementioned first embodiment, the example is carried out on a substrate 31 and two signal terminals 36, 37 are provided. Except the fashion and distance of feeding conducting strips 32, 33 as well as the shape and length of comb conducting structures 34, 35, this embodiment utilizes the serial inductive elements 381, 391 in conducting strips of comb conducting structures as the induced electromagnetic field under high electromagnetic coupling effect. Besides, this embodiment is provided with the function of impedance adjustment and circuit simplification.

Figure 4:
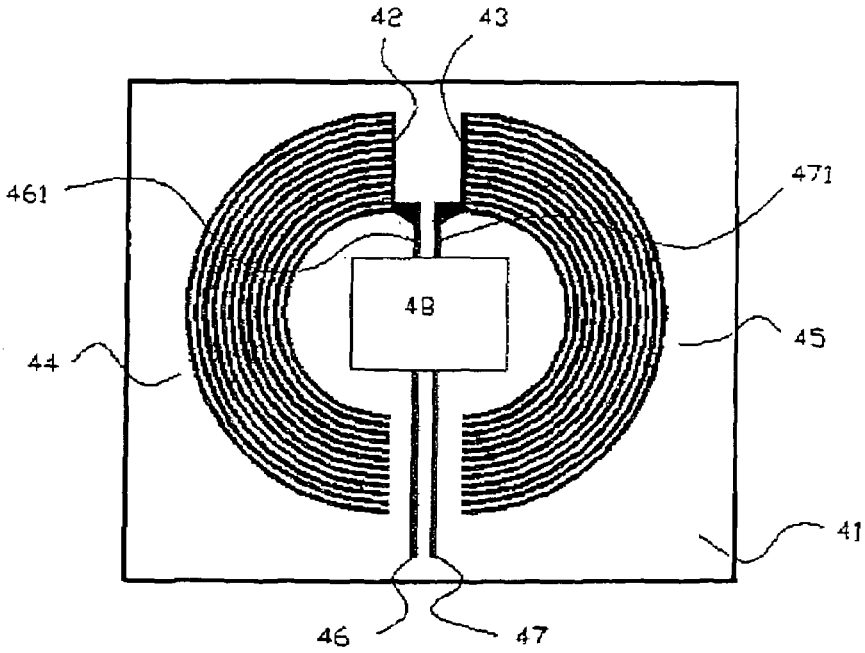
FIG. 4 is a plane view of a comb dipole antenna according to the fourth embodiment of this invention.

Still another embodiment of this invention, as shown in FIG. 4, it shows an active antenna including two feeding conducting strips 42, 43, two comb conducting structures 44, 45, and signal amplifier 48. The comb conducting structures 44, 45 bend in arc-shape and adjusted antenna pattern. For a transmitting antenna, the signals are fed from signal terminal 46, 47, and are input into the feeding conducting strips 42, 43 after amplified by the signal amplifier 48, such as power amplifier, then get into the comb conducting structures 44, 45. For a receiving antenna, the signals are transmitted via the feeding conducting strips 42, 43, and then into the signal terminal 46, 47 after amplified by signal amplifier 48, such as Low Noise Amplifier (LNA). The rest structures and principles are the same with first embodiment. Filter can be used between the feeding conducting strips 42, 43 and the amplified 48.

Figure 5:
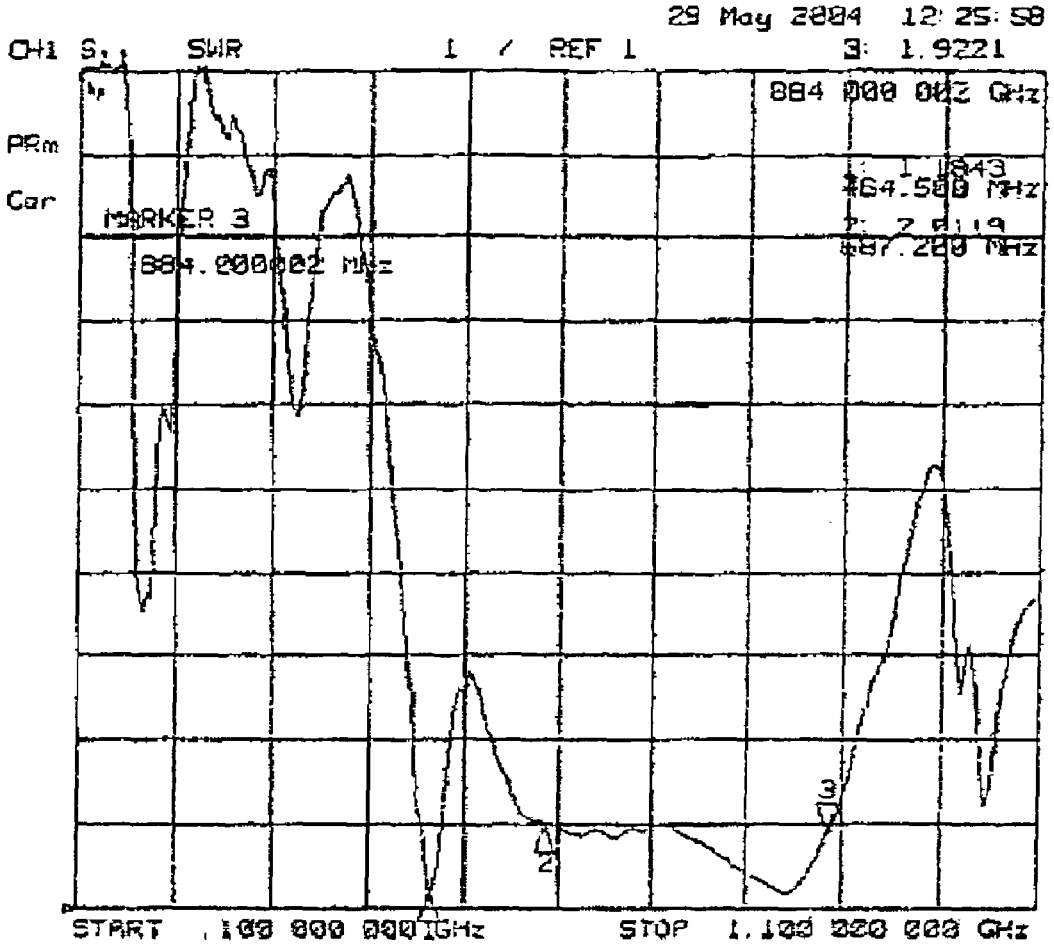
FIG. 5 is a frequency to standing wave ratio response diagram according to the structure in the first embodiment
Figure 6:
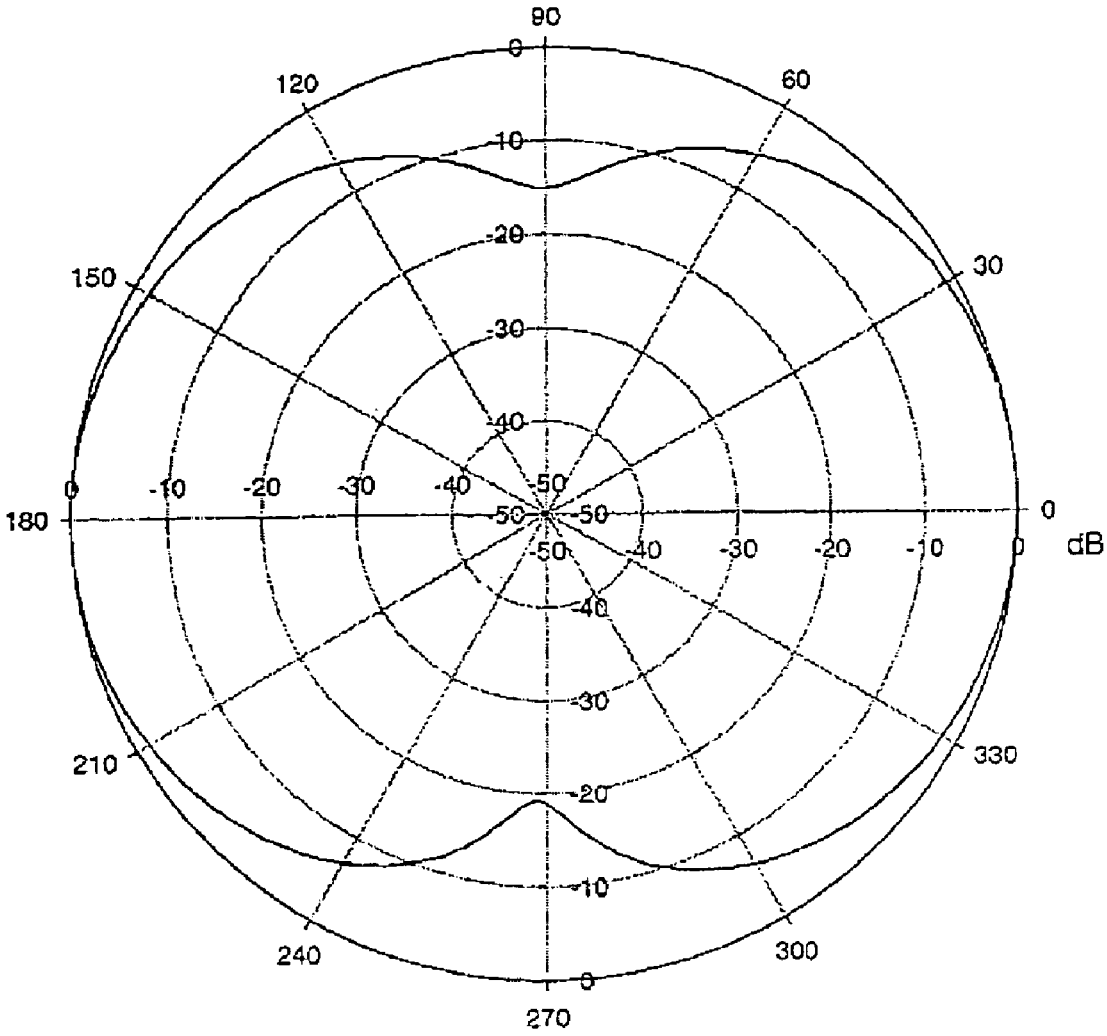
FIG. 6 is an E-plane antenna pattern graph according to the structure in first embodiment.

FIG. 5 illustrates a frequency standing wave ratio response diagram of the structure in the first embodiment. Since the frequency range, which the standing wave ratio is less than two, arrives at 40%, the operation bandwidth is much broader than that of ordinary dipole antenna. FIG. 6 is an E-plane antenna pattern graph measured at 557 Hz of the structure in the first embodiment. This radiation pattern is that of dipole antenna.

Although above embodiments are applied on single substrate, multi-layer structure with equivalent manner should be included in this invention as an antenna. The embodiments of this invention are not only indoor antennas but also vehicle antennas. The car antenna of this invention can (a) be attached on the glass of a car with adhesive materials, hooks, or suction cup, (b) utilize the glass of a car as a substrate and apply circuits thereon or therein, (c) be placed in or behind the rear view mirror, or (d) employ transparent media as a substrate and adjust the slots in comb structure so that the antenna would not influence the effect of brake light as installed between the glass and third brake light.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

I claim:

1. A comb dipole antenna comprising:

a substrate made of nonconductor material adaptable for electromagnetic radiation;

two feeding conducting strips on said substrate with one terminal as signal feeding points;

two comb conducting structures, each of said two comb conducting structures comprising three or more conducting strips spaced apart from each other; wherein said comb conducting structures connect to said feeding conducting strips by one end of said conducting strips therein, respectively;

signals being fed from said terminals of said feeding conducting strips into said conducting strips of comb conducting structures through said feeding conducting strips; wherein the parts of said conducting strips in comb conducting structures generate an oscillation with half wavelength of operation frequency or integral multiple of the half wavelength in cooperation with said feeding conducting strips to produce electromagnetic radiation.

2. The antenna as set forth in claim 1, wherein said feeding conducting strips are both mounted on the same side of said substrate.

3. The antenna as set forth in claim 1, wherein said feeding conducting strips are mounted on opposite side of said substrate.

4. The antenna as set forth in claim 1, wherein said comb conducting structures are both mounted on the same side of said substrate.

5. The antenna as set forth in claim 1, wherein said comb conducting structures are both mounted on opposite side of said substrate.

6. The antenna as set forth in claim 1, wherein said conducting strips of comb conducting structures comprise inductive structures.

7. A comb dipole antenna comprising:

a substrate made of nonconductor fit for electromagnetic radiation;

two signal terminals for transmitting and/or receiving electromagnetic signals;

four feeding conducting strips, wherein two of said feeding conducting strips are mounted on one side of said substrate and the other two are mounted on the other side of substrate;

two of said feeding conducting strips, mounted on different side of said substrate, connecting with each other by conducting via holes and are both connected to one of said signal terminals;

four comb conducting structures, each comprised of three or more conducting strips spaced from each other and arranged to form a comb structure;

said comb conducting structures connect to said feeding conducting strips by one end of said conducting strips therein, respectively;

signals fed from said terminals of feeding conducting strips entering said conducting strips of comb conducting structures through said feeding conducting strips;

said conducting strips in comb conducting structures generating the oscillation with half the wavelength of operation frequency or its integral multiple in cooperation with the parts of said feeding conducting strips to produce electromagnetic radiation; and said signals being processed in opposite direction while being received.

8. The comb dipole antenna as set forth in claim 7, wherein said conducting strips of comb conducting structures comprise inductive structures.

9. A comb dipole antenna comprising:

a substrate made of nonconductor fit for electromagnetic radiation;

two signal terminals for transmitting and/or receiving electromagnetic signals;

two feeding conducting strips mounted on the surface of said substrate;

signal amplifier, linked between said signal terminals and said feeding conducting strips, for amplifying said electromagnetic signals;

two comb conducting structure, each comprised of three or more conducting strips spaced from each other and arranged to form a comb structure;

said comb conducting structures connect to said feeding conducting strips by one end of said conducting strips therein, respectively;

while being transmitted, signals fed from said terminals of feeding conducting strips entering said feeding conducting strips after amplified by said signal amplifier, and then get into said comb conducting structures; and said conducting strips in comb conducting structures generating the oscillation with half the wavelength of operation frequency or its integral multiple in cooperation with the parts of said feeding conducting strips to produce electromagnetic radiation.

10. A comb dipole antenna comprising:

a substrate made of nonconductor fit for electromagnetic radiation;

two signal terminals for transmitting and/or receiving electromagnetic signals;

two feeding conducting strips mounted on the surface of said substrate;

signal amplifier, linked between said signal terminals and said feeding conducting strips, for amplifying said electromagnetic signals;

two comb conducting structure, each comprised of three or more conducting strips spaced from each other and arranged to form a comb structure;

said comb conducting structures connect to said feeding conducting strips by one end of said conducting strips therein, respectively;

while being received, signals entering said signal terminals from said conducting structures through said feeding conducting strips after amplified by said signal amplifier; and said conducting strips in comb conducting structures generating the oscillation with half the wavelength of operation frequency or its integral multiple in cooperation with the parts of said feeding conducting strips to produce electromagnetic radiation.

* * * * *